US007039958B2

(12) United States Patent
Henricksen

(10) Patent No.: US 7,039,958 B2
(45) Date of Patent: May 9, 2006

(54) DUAL ADJUSTABLE STRAP APPARATUS AND METHOD

(75) Inventor: Doug Henricksen, Highland Village, TX (US)

(73) Assignee: Promarx Specialties, USA, Inc., Arlington, TX (US)

( * ) Notice: Subject to any disclaimer, the term of this patent is extended or adjusted under 35 U.S.C. 154(b) by 211 days.

(21) Appl. No.: 10/320,077

(22) Filed: Dec. 16, 2002

(65) Prior Publication Data

US 2004/0111784 A1 Jun. 17, 2004

(51) Int. Cl.
*A41B 1/08* (2006.01)

(52) U.S. Cl. ..... 2/338; 2/311; 2/126

(58) Field of Classification Search ..... 2/1, 2/23, 24, 115, 123–126, 305, 317, 318, 321, 2/244, 257, 269, 270, 920, 338, 311, 183, 2/171.4, 171.5, 171.8, 323; 24/302, 3.1, 24/71 SK, 16 R, 304, 306, 450, 30.5 R, 442; 602/75, 78, 61, 60, 62–65; 128/99.1, 100.1, 128/101.1; 450/64, 79, 83, 85, 77, 155; 600/41; 136/248

See application file for complete search history.

(56) References Cited

U.S. PATENT DOCUMENTS 1,157,265 A * 10/1915 Tutelman ..... 2/269
2,626,396 A * 1/1953 Kanin ..... 2/269
2,675,554 A * 4/1954 Gertz ..... 2/80
3,845,769 A * 11/1974 Shaw ..... 602/62
4,215,687 A * 8/1980 Shaw ..... 602/60
4,384,583 A * 5/1983 Speelman et al. ..... 606/203
4,475,252 A * 10/1984 Peyser et al. ..... 2/125
4,733,439 A * 3/1988 Gentry ..... 206/338
4,858,249 A * 8/1989 Stewart ..... 2/305
4,939,818 A * 7/1990 Hahn ..... 24/16 R
4,964,401 A * 10/1990 Taigen ..... 482/93
4,991,234 A * 2/1991 Greenberg ..... 2/170
5,120,300 A * 6/1992 Shaw ..... 602/61
5,142,743 A * 9/1992 Hahn ..... 24/16 R
5,168,603 A * 12/1992 Reed ..... 24/16 R
5,316,022 A * 5/1994 Schiek, Sr. ..... 128/876
5,460,308 A * 10/1995 Hahn ..... 224/257
5,548,871 A 8/1996 Trethewey
5,553,324 A * 9/1996 Emerson ..... 2/158
5,575,011 A * 11/1996 Allen ..... 2/227
5,692,239 A * 12/1997 Lewis ..... 2/125
5,749,504 A * 5/1998 Bieker ..... 224/221
5,787,511 A * 8/1998 Garside ..... 2/269
5,882,320 A * 3/1999 Peterson ..... 602/3
5,987,650 A * 11/1999 Carroll ..... 2/244

(Continued)

*Primary Examiner*—Alissa L. Hoey
(74) *Attorney, Agent, or Firm*—Scott L. Harper; Carstens & Cahoon, LLP

(57) ABSTRACT

The general method and apparatus of the invention comprises an adjustable strap system to secure one object to another, or one or more objects in a folded, rolled, or gathered position. In one embodiment, the invention comprises a single elongated strap of material having a first end and a second end, one end narrower than the other, a first side and a second side, four fastening surfaces or fasteners, three on one side and one on the opposite side, two positioned on each side of the narrow strap, and two positioned on the wide strap same side opposite the narrow strap. In the fastened state, the adjustable strap system secures the narrow strap by mating four opposing fastening surfaces thereby resulting in a dual locking adjustable strap system. In an alternative embodiment, two separate straps may be utilized with the dual locking mechanism of the present invention.

5 Claims, 8 Drawing Sheets

U.S. PATENT DOCUMENTS 6,006,364 A * 12/1999 Newsom et al. ..... 2/323
6,081,925 A 7/2000 Reiber
6,126,639 A * 10/2000 Sutherland et al. ..... 604/179
6,148,445 A * 11/2000 Spruill ..... 2/125
6,175,961 B1 * 1/2001 Linden et al. ..... 2/125
6,272,691 B1 8/2001 Henricksen et al.
6,317,933 B1 * 11/2001 Suenaga ..... 24/16 R
6,506,175 B1 * 1/2003 Goldstein ..... 602/60
6,564,385 B1 * 5/2003 McCarthy ..... 2/16
6,622,346 B1 * 9/2003 Graham et al. ..... 24/16 R
6,681,405 B1 * 1/2004 Yachimec et al. ..... 2/104
6,687,916 B1 * 2/2004 Thompson ..... 2/170
6,701,580 B1 * 3/2004 Bandyopadhyay ..... 24/16 R
6,775,846 B1 * 8/2004 LaFauci et al. ..... 2/125
6,807,680 B1 * 10/2004 Sloot ..... 2/16
2003/0009859 A1 * 1/2003 Goss et al. ..... 24/302
2003/0187375 A1 * 10/2003 Gaylord ..... 602/26

* cited by examiner

DUAL ADJUSTABLE STRAP APPARATUS AND METHOD

BACKGROUND OF THE INVENTION

1. Technical Field

The invention disclosed herein is directed generally to fastening devices to secure one object to another, or to secure one or more objects in a folded, rolled, or gathered position and, in particular, the invention relates to an adjustable fastening device that provides mating surfaces for fixing in place clothing items and sports apparel.

2. Description of Related Art

It has become common for basketball, soccer, softball, volleyball players and other sports participants to gather the sleeves of their garments about the shoulder region while practicing and participating in athletic sports. Sleeve holders are especially popular among athletes because of the additional freedom of movement that can be achieved by gathering and holding the sleeves on the top of the shoulder. The users of such devices often suggest that the ability to pull their sleeves up on their shoulders also makes them feel cooler, which helps to prevent heat exhaustion and heat stroke. This makes sense because the upper portion of the arm, shoulder, and the underarms become exposed to the air. Older and larger participants, who would prefer to use sleeve holders, often find them uncomfortable due to the fact that they are physically bigger and therefore wear larger shirts and apparel. Unfortunately, this poses a problem with existing sleeve holders known in the art, as they are non–adjustable "one size fits all" in dimension, thereby limiting their use to younger and smaller users.

Several prior art devices have been used to secure garment sleeves in the gathered position, so that the sleeves do not fall during play. One such device is shown in U.S. Pat. No. 6,081,925 (Reiber). The Reiber device comprises a strap having one fastening means at one end and a second fastening means at the other end. The strap is wrapped around the gathered sleeve, and the two fastening means are connected to one another to secure the strap in place. The two fastening means are located on opposite sides of the strap, and at opposite ends of the strap. The device also has a label attached to one side of the strap. Another such device is shown in U.S. Pat. No. 6,272,691 (Henricksen, et al.). The device comprises an elongated strap of material having a first end and a second end. An elastic loop attached to the first end of the strap, and a fastener attached to the second end of the strap passes through the loop, folds against itself, connecting the fasteners and securing the folded end of the loop.

However, utilization of these prior art devices may be impeded as some sports and sport referees have disallowed the use of these prior art garment fasteners due to safety reasons. For example, some soccer referees have prohibited the use of sleeve holders produced under U.S. Pat. No. 6,081,925 and U.S. Pat. No. 6,272,691 because a player may get their hand or fingers caught in the garment fastening device, resulting in serious injury to one or both players. Also, the sleeve holder may become disengaged and fall off during sports play through multiple instances of physical contact with one or more players and/or the playing surface. The likelihood of this taking place increases if the fastening mechanism has been misaligned by the wearer. If the sleeve holder detaches from the player and comes to rest upon the athletic field of play, a player may possibly step upon and slip on the sleeve holder potentially causing serious injury to the player and others. The same scenario can be applied to athletes wearing caps or hats during an event. If the hat becomes loose and falls from the player's head on to the field of play, the player or other players may slip or fall causing potential injury.

Therefore, a need in the art exists for a device that has both an adjusting means and a dual locking fastening apparatus which can provide an adequate and safe restraining system so as to prevent athletic apparel from coming loose or falling off during sport activities and that can compensate for any misalignment of the fastening mechanisms by the wearer. Furthermore, a need in the art exists for a fastening system with a flexible utility that will prevent a player's hand or finger's from being unrealeasably caught in the garment restraint apparatus during the course of play and does not contain metal or plastic components which can expose the wearer and other athletes to serious injury.

SUMMARY OF THE INVENTION

The general method and apparatus of the invention disclosed herein is to secure one object to another, or one or more objects in a folded, rolled, or gathered position. The invention also relates to a method and apparatus used to secure hair, ponytails, pigtails, headbands, caps, and garments around the waist, leg, arm or head of the user. In one embodiment of the invention, the "single strap embodiment" is used in a configuration appropriate for holding a sleeve of a garment in the gathered position. The sleeve holder embodiment has a single elongated strap of material having a first end and a second end, one end narrower than the other, a first side and a second side, four fastening surfaces or fasteners, three on one side and one on the opposite side, two positioned on each side of the narrow strap, and two positioned on the wide strap same side opposite the narrow strap. In another embodiment of the invention, the "two strap embodiment" is shown implemented with a baseball cap wherein two separate straps are utilized with the dual locking mechanism of the present invention. The narrow strap has loops on each side of one end of the narrow strap while the wide strap has hooks on opposing sides, such that when the narrow strap is threaded through a webbing hole in the wide strap, the hooks and loops on each strap mate with another to form a dual locking system.

Preferably, the strap material is comprised of polyester elastic webbing although other fabric and textile materials may be used. The preferable fastening mechanism is comprised of cooperating hook and loop fastening fabric. The dual adjustable strap apparatus may also have labels coupled to both the upper and lower side of the strap, which may depict the user's sport, logo, name, or custom artwork. In a preferred embodiment, the label is comprised of a textile, which is 65% cotton and 35% polyester. However it could be any textile that lends itself to one of the textile decorating processes. The above, as well as additional objects, features, and advantages of the invention will become apparent in the following detailed drawings.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings wherein:

DETAILED DESCRIPTION

Figure 1:
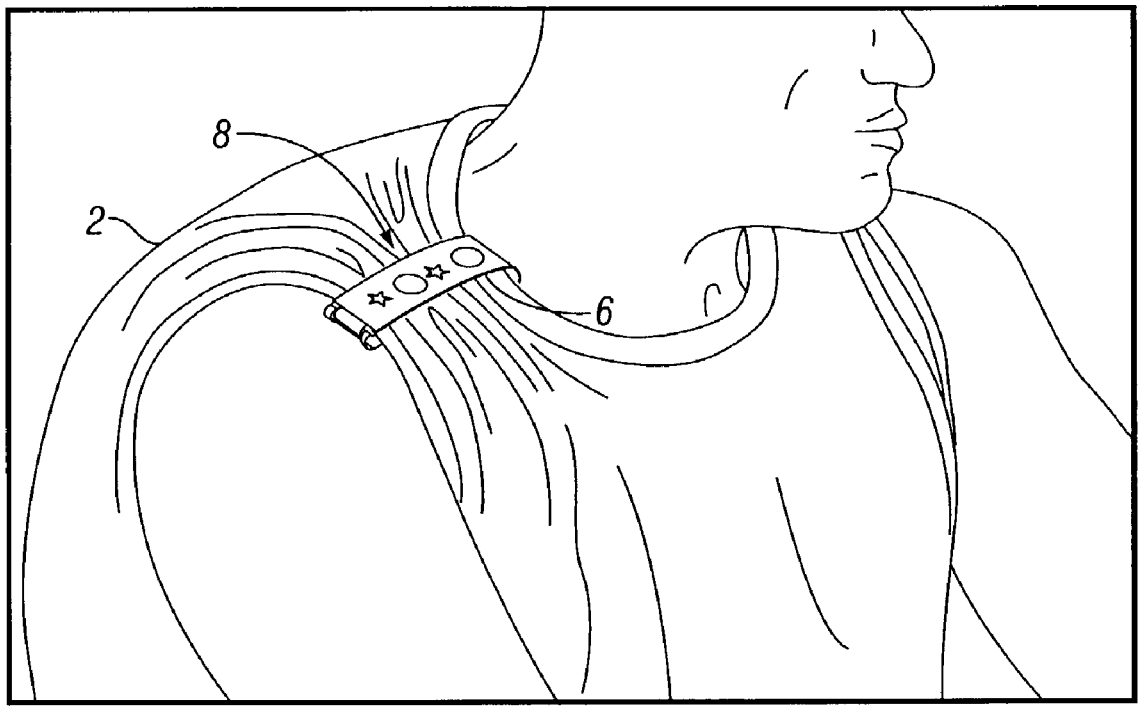
FIG. 1 is a perspective view of the single strap embodiment in the sleeve holder configuration holding a sleeve of a garment in a gathered position.
Figure 2:
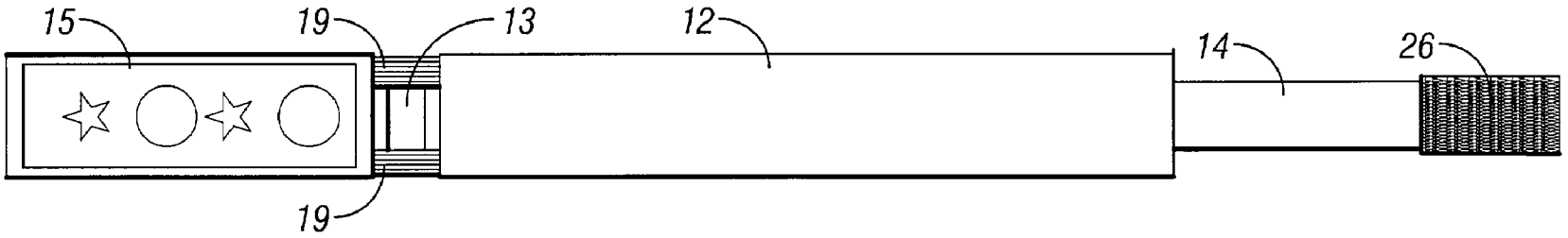
FIG. 2 is a top plan view of the single strap embodiment in the sleeve holder configuration laid flat.
Figure 3:
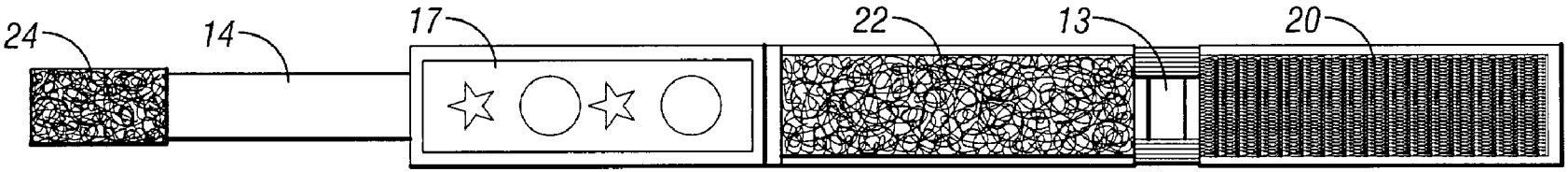
FIG. 3 is bottom plan view of the single strap embodiment in the sleeve holder configuration laid flat.
Figure 4:
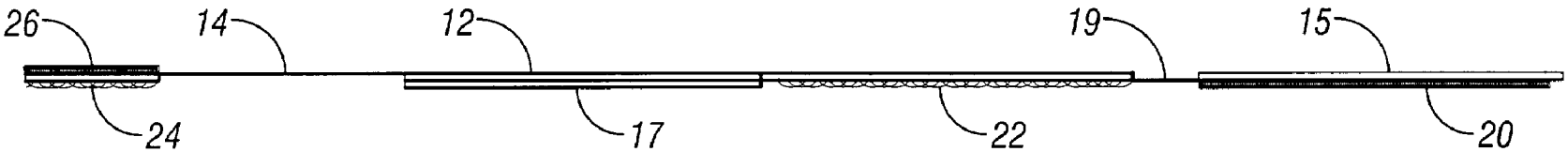
FIG. 4 is a side elevation of the single strap embodiment in the sleeve holder configuration laid flat; and, FIG. 5 is a perspective view of the two strap embodiment in a baseball hat configuration in the fastened position.

Turning now to FIG. 1, a single strap assembly 8 in a sleeve holder embodiment is shown. In this embodiment, the single strap assembly 8 is threaded through the sleeve 6 opening and up through the neck opening of the garment 2. FIGS. 2–4 are various depictions of the single strap assembly 8 showing the various components thereof. The single strap assembly 8 is comprised of wide strap 12 and narrow strap 14 with a webbing hole 13. A first fastening surface 20, a second fastening surface 22, a third fastening surface 24, and a fourth fastening surface 26 may be attached to wide strap 12 and narrow strap 14 by sewing, adhesives or other attachment means as known in the textile art. A first label 15 and second label 17 may also be attached to wide strap 12 by sewing, adhesives or by other attachment means as known in the textile art. The webbing hole 13 is formed by removing a portion of wide strap 12 located between fastening surfaces 20, 22 or alternatively, elastic straps 19 may be connected to wide strap 12 defining webbing hole 13 so as to provide the entire assembly 8 with increased flexibility during athletic movement or contact.

Double Strap Assembly Embodiment

Figure 5:
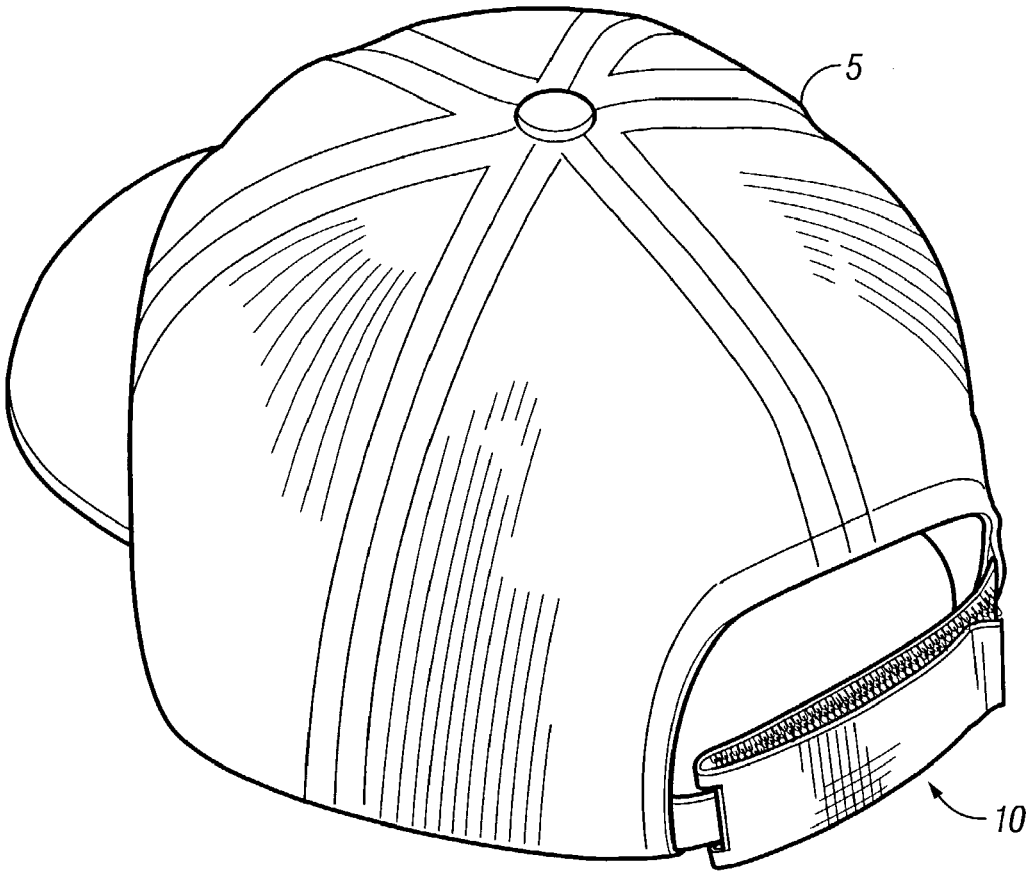

FIG. 5 is a depiction of the double strap assembly 10 shown integrated as a fastening system for baseball hat 5. In this embodiment, wide strap 12 and narrow strap 14 are shown as separate straps attached at one end to the baseball style hat 5.

Figure 6:
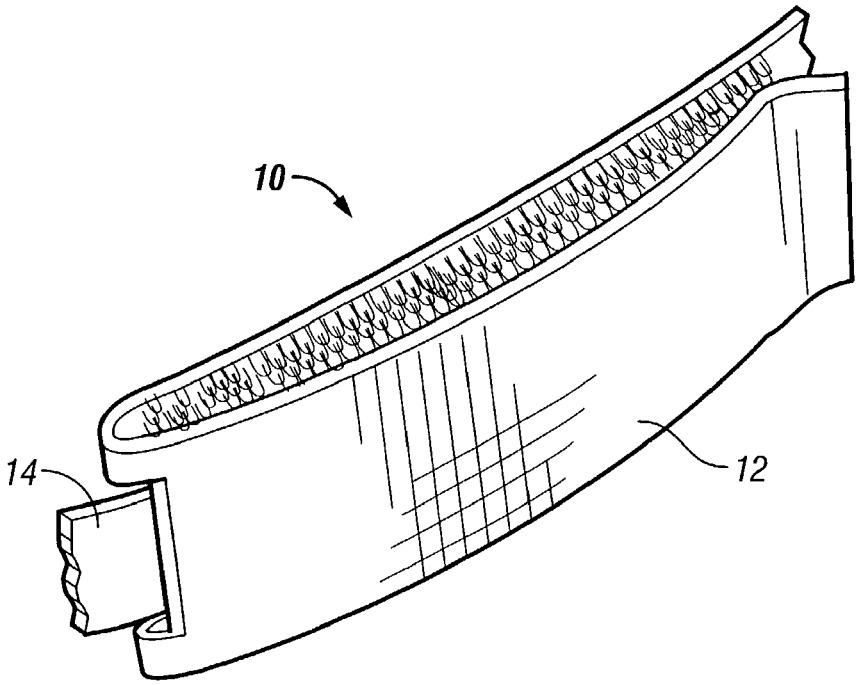
FIG. 6 is a close up perspective view of the two strap embodiment.
Figure 7:
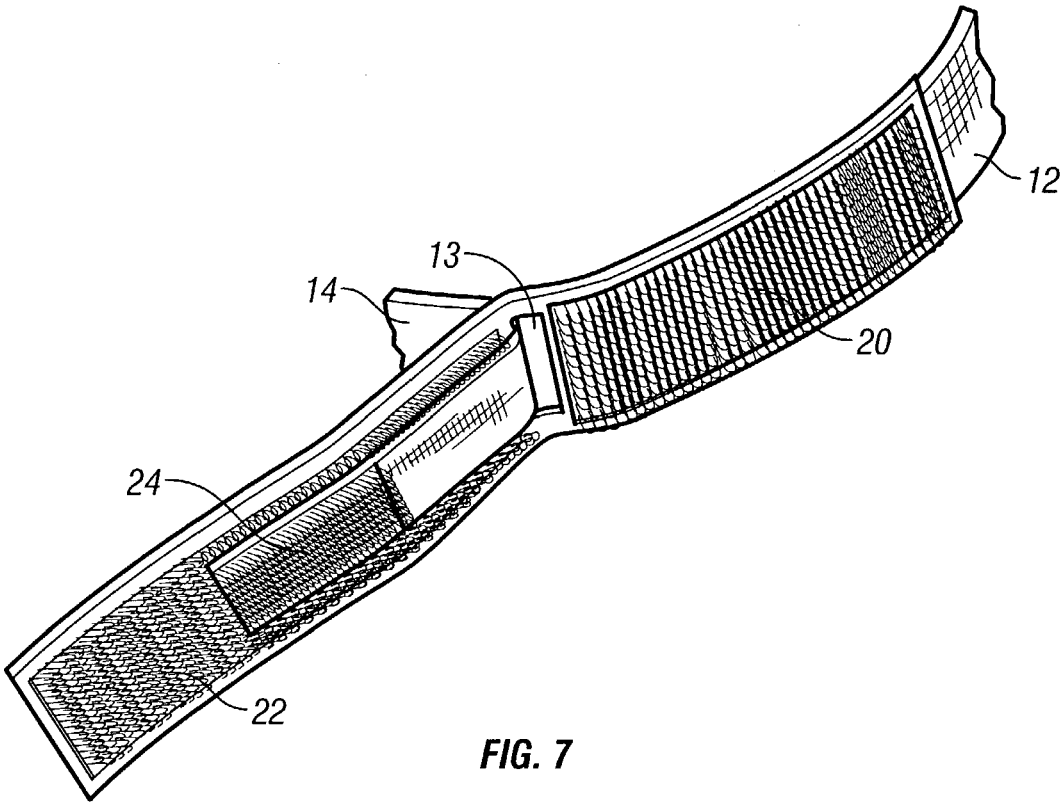
FIG. 7 is a perspective view of the two strap embodiment showing one side fastened.
Figure 8:
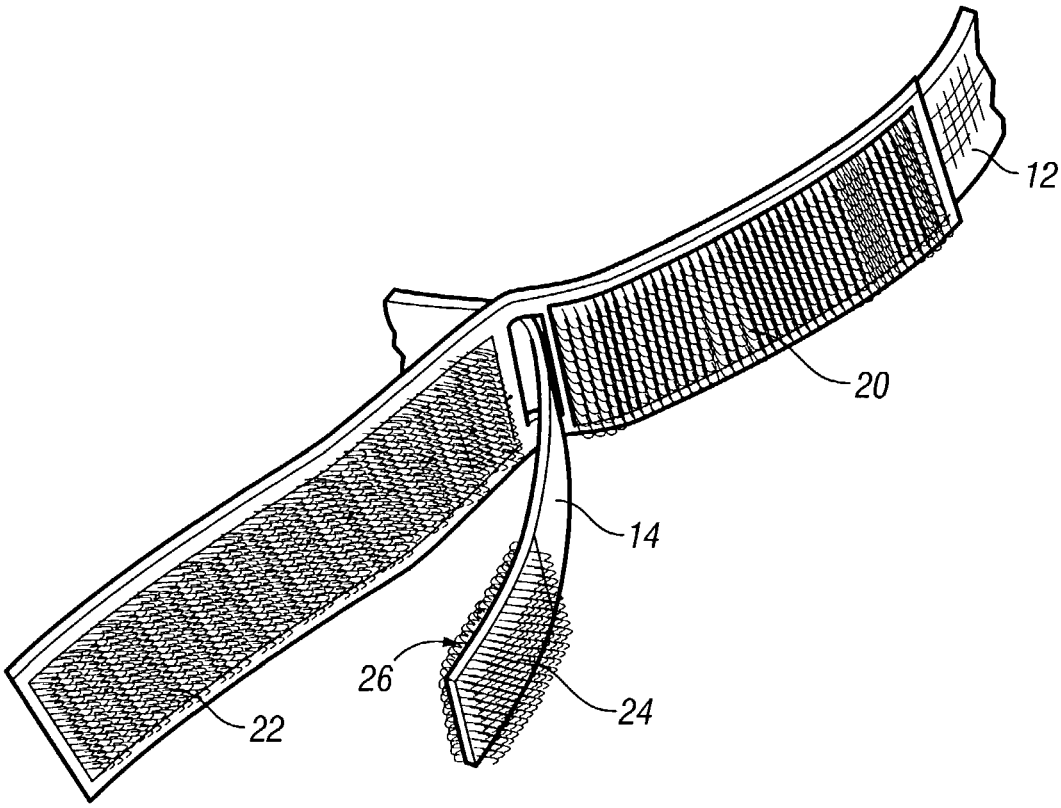
FIG. 8 is another perspective view of the two strap embodiment without either side fastened.

FIG. 6 is a close up view of double strap assembly 10 shown in the fastened positioned wherein narrow strap 14 is secured from movement by mating hook and loop fasteners attached to both wide strap 12 and narrow strap 14. FIGS. 7 and 8 provide further detail as to the characteristics and operation of the double strap assembly 10. The double strap assembly 10 is comprised of two separate straps, wide strap 12 and narrow strap 14. First and second fastening surfaces 20, 22 are attached to wide strap 12 with a webbing hole 13 located between fastening surfaces 20, 22. Third and fourth fastening surfaces 24, 26 are attached to opposite sides of narrow strap 14.

Figure 9:
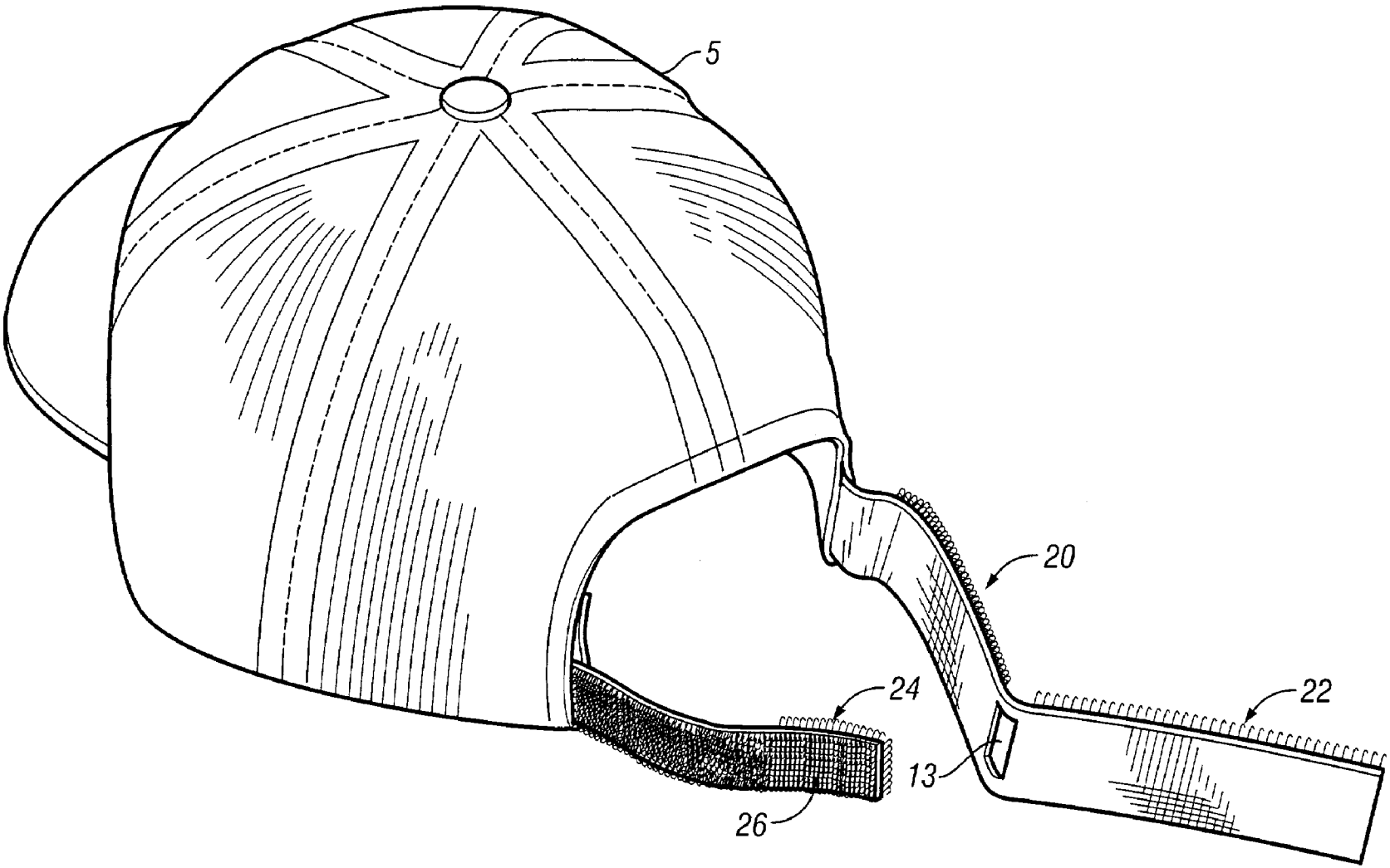
FIG. 9 is a perspective view of the two strap embodiment in a baseball hat configuration shown in the unfastened position.

FIG. 9 depicts the double strap assembly in the unfastened position. One method of using the double strap assembly entails inserting narrow strap 14 through webbing hole 13 and connecting the first and third fastening surfaces 20, 24 thereby attaching one side of wide strap 12 with narrow strap 14. Next, the user simply connects second and fourth fastening surfaces 22, 26 by folding the remaining fastening surfaces 22, 26 together. This results in the narrow strap being secured on each side by the first, second, third and fourth fastening surfaces 20, 22, 24, 26 in proper alignment without unused, exposed fastening surfaces. It should be noted that the user may also initially connect second and fourth fastening surfaces 22, 26 after inserting the narrow strap 14 through webbing hole 13 in wide strap 12, then connect the first and third fastening surfaces 20, 24 by folding the first and third fastening surfaces 20, 24 together.

Single Strap Assembly Embodiment

Figure 10:
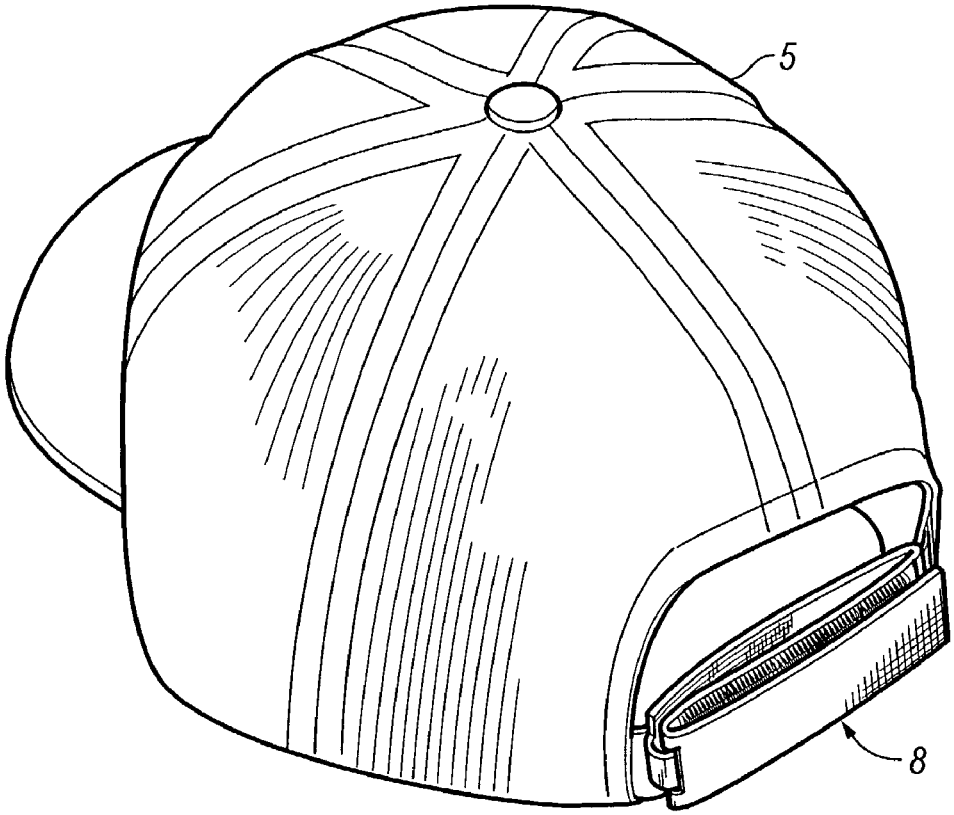
FIG. 10 is a perspective view of the single strap embodiment in the baseball hat configuration shown in the fastened position.
Figure 11:
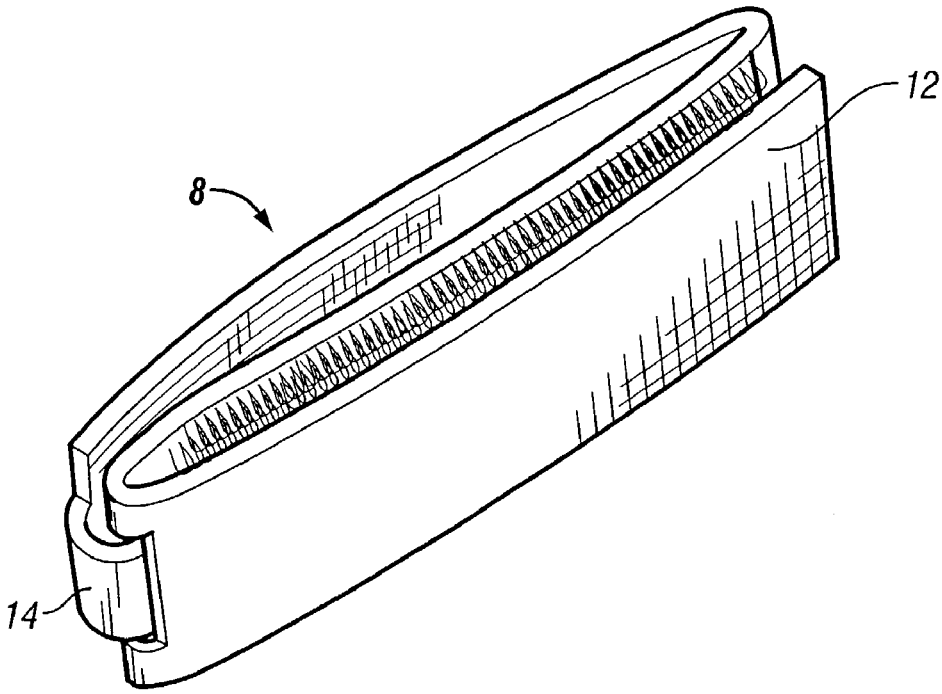
FIG. 11 is a close up perspective view of the single strap embodiment shown in the fastened position.

FIG. 10 is a depiction of the single strap assembly 8 shown integrated as a fastening system for baseball hat 5. FIG. 11 is a close up view of single strap assembly 8 shown in the fastened positioned wherein narrow strap 14 is secured from movement by mating hook and loop fasteners attached to both wide strap 12 and narrow strap 14. In this embodiment, wide strap 12 and narrow strap 14 constitute one piece and may be connected by stitching, adhesives or by other attachment means as known in the textile art.

Figure 12:
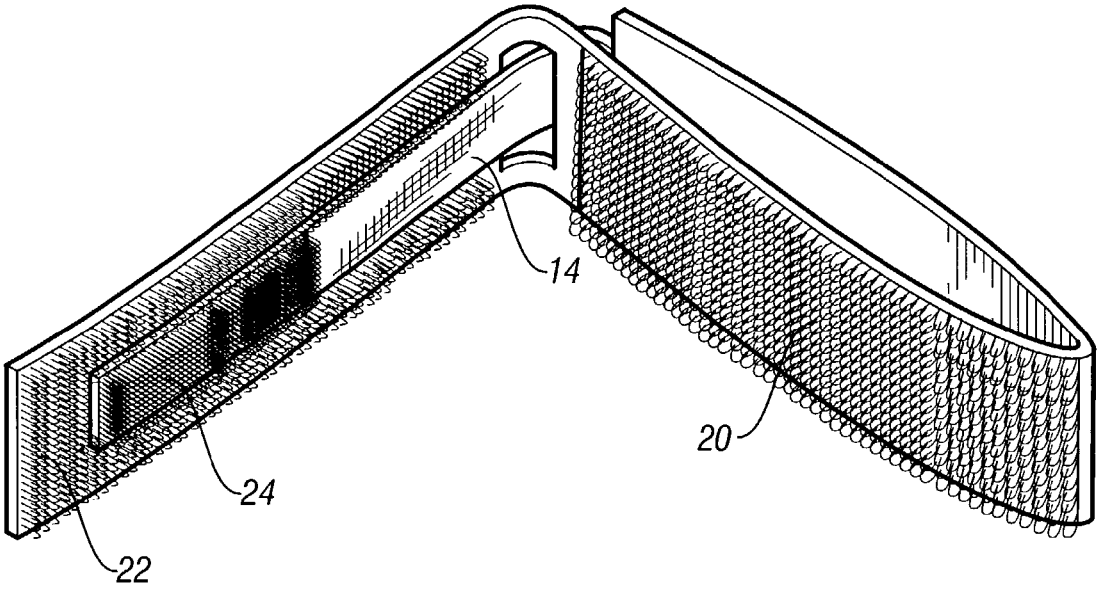
FIG. 12 is a perspective view of the single strap embodiment showing one side fastened.
Figure 13:
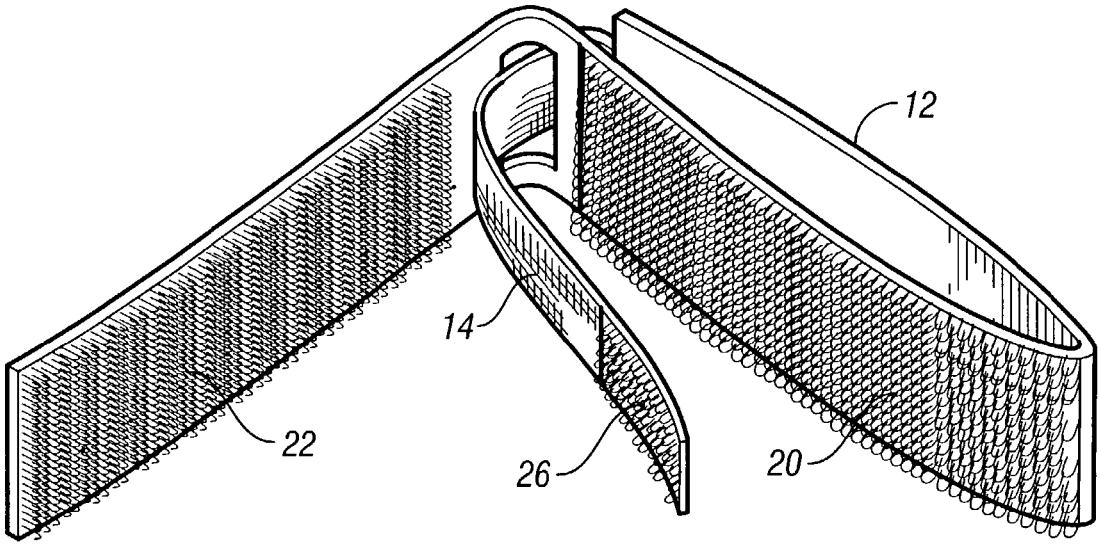
FIG. 13 is a perspective view of the single strap embodiment in the unfastened position with the narrow strap threaded through the webbing hole in the wide strap; and, FIG. 14 is a perspective view of the single strap embodiment in the baseball hat configuration shown in the unfastened position.

FIGS. 12 and 13 provide further detail as to the characteristics and operation of the single strap assembly 8. The single strap assembly 8 is comprised of two separate straps attached together constituting wide strap 12 and narrow strap 14. Fastening surfaces 20, 22 are attached to wide strap 12 with a webbing hole 13 located between fastening surfaces 20, 22. Fastening surfaces 24, 26 are attached to opposite sides of narrow strap 14. In this depiction, fastening surfaces 20, 22 are comprised of hook fasteners and fastening surfaces 24, 26 are comprised of loop fasteners which when mated form a strong interlocking fastening mechanism which may be repetitively fastened and unfastened for adjustability and comfort by the user as desired.

With reference back to FIGS. 1, 12 and 13, one method of using the single strap assembly 8 in the adjustable sleeve holder 8 configuration comprises inserting the wide strap 12 of the adjustable sleeve holder through the neck opening or the narrow strap 14 through the sleeve opening so that the side with the first, second and third fastening surfaces 20, 22, 24 faces the user's shoulder. Although the single strap adjustable sleeve holder 8 could be inserted and worn either way as preferred by the user, by having the narrow strap 14 positioned at the neck opening makes the device more comfortable than traditional sleeve holders. The user then forms the adjustable sleeve holder into a loop by bringing the third and fourth fastening surfaces 24, 26 positioned on each side of the narrow strap 14 through the webbing hole 13 so that the sleeve 6 is disposed inside the resulting loop. Then the user connects the first and third fastening surfaces 20, 24 allowing the user to adjust the size of the loop required to comfortably secure the sleeve 6. The user then folds the second fastening surface 22 on to the fourth fastening surface 26, creating a dual locking system for added strength and safety. It should be noted that the user may also initially connect second and fourth fastening surfaces 22, 26 after inserting the narrow strap 14 through webbing hole 13 in wide strap 12, then connect the first and third fastening surfaces 20, 24 by folding the first and third fastening surfaces 20, 24 together.

Figure 14:
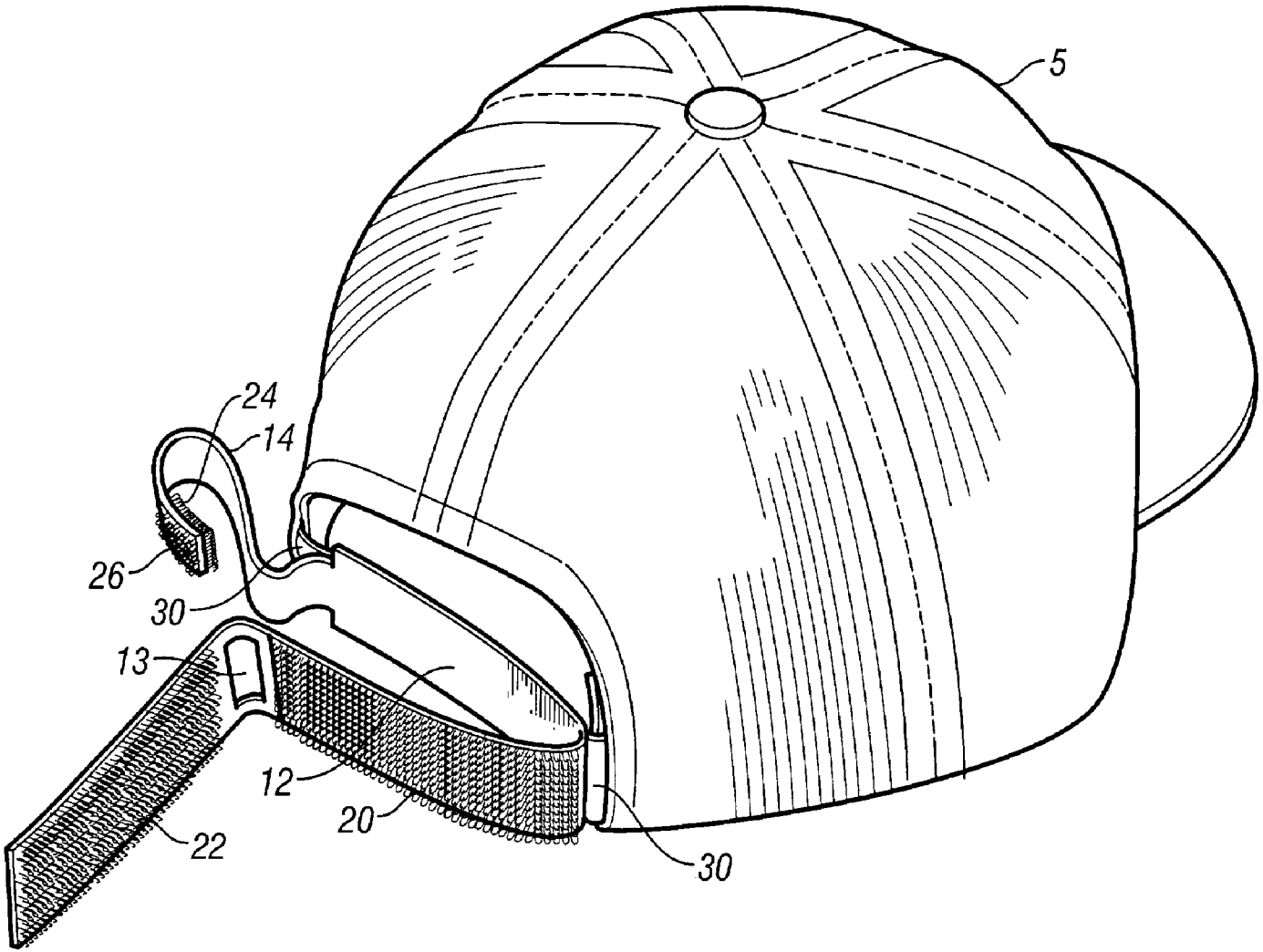

FIG. 14 shows the single strap assembly 8 incorporated as an adjustable baseball style hat fastening system which is operable in accordance with the method previously disclosed. It can be appreciated that the single and dual strap assembly compensates for greater adjustability around or in conjunction with various geometric shapes and prevents misalignment of the hook and loop fastening surfaces 20, 22, 24, 26 at the same time. Also, the dual locking nature of the invention does not expose the user or others to exposed hook or loop fasteners which can catch on other objects or persons during use. During manufacture, the webbing hole 13 can be created by sewing on the wider strap 12 end opposite the narrow strap 14 end with two pieces of elastic 19, or by die cutting the webbing, making it less expensive and easier to produce.

The method and apparatus of the invention disclosed herein has several advantages over the prior art. In addition to the functional and safety improvements made in reference to U.S. Pat. No. 6,081,925 and U.S. Pat. No. 6,272,691, the invention disclosed herein eliminates the potentially fragile and breakable plastic loop or elastic loop components that a player can catch a finger on resulting in injury and compensates for any misalignment of the fastening surfaces that would affect the appearance or mechanical integrity of the invention herein. Moreover, prior art strap systems adjust by the user increasing or decreasing the amount of hook and loop fastener overlap which results in stronger or weaker fastening capacity depending on the circumference or size of the object the fastening assembly is placed around or being adjusted to hold. As the amount of hook and loop fastener overlap is decreased, the fastening mechanism becomes weaker thereby resulting in the assembly becoming detached from the user or releasing the tension applied to the object the fastening assembly is integrated with, which in this disclosure is a sleeve holder or a baseball hat. In turn, this can result in the sleeve holder assembly 8 or hat 5 falling off onto the floor and endanger or cause serious harm to the user and other players. The invention disclosed herein overcomes these disadvantages by providing a simple apparatus which allows a user to properly align and adjust the assembly 8, 10 without leaving exposed fastening surfaces and the attendant decline in fastening strength.

While the invention has been particularly shown and described with reference to a preferred embodiment, it will be understood by those skilled in the art that various changes in form and detail may be made therein without departing from the spirit and scope of the invention.

What is claimed is:

1. An adjustable strap assembly consisting of:

a single elongated strap of material having a wide strap end and a narrow strap end;

a first and a second fastening surface attached to the same side of the wide strap end and which are separated by a webbing hole;

a third and a fourth fastening surface attached to opposite sides on the narrow strap end and wherein the narrow strap end is inserted through the webbing hole, and further wherein the narrow strap end is secured by the folding of the wide strap end about the narrow strap end thereby forming a continuous band; and wherein the first, second, third and fourth fastening surfaces are made of hook and loop fastening material so as to cooperate to adjustably secure the narrow strap end between the third and fourth fastening surfaces of the folded wide strap end.

2. A method of holding a sleeve of a garment in a gathered position on the shoulder of a garment wearer, comprising the steps of;

placing a strap having a narrow strap end and a wide strap end through the sleeve and over a neck opening of the garment;

inserting the narrow strap end through a webbing hole in the wide strap end of the strap; folding the narrow strap end against the wide strap end to form a loop; and, folding the wide strap end over the narrow strap end.

3. The method of claim 2 wherein the strap is made of polyester and at least one label attached to the strap is made of a cotton and polyester mix.

4. The method of claim 2 wherein the narrow strap end and wide strap end are attached by cooperating hook and loop fasteners.

5. The method of claim 2 further comprising the step of adjusting the strap by additional pulling of the narrow strap end through the webbing hole after securing the narrow strap end between the folded wide strap end.

* * * * *